US008272756B1

(12) United States Patent
Patrick

(10) Patent No.: US 8,272,756 B1
(45) Date of Patent: Sep. 25, 2012

(54) LED-BASED LIGHTING SYSTEM AND METHOD

(75) Inventor: Ellis W. Patrick, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/973,338

(22) Filed: Dec. 20, 2010

Related U.S. Application Data

(63) Continuation of application No. 12/075,184, filed on Mar. 10, 2008, now Pat. No. 7,887,216.

(51) Int. Cl.
*F21V 7/20* (2006.01)

(52) U.S. Cl. ..... 362/218; 362/217.01; 362/217.02; 362/219; 362/249.02; 362/294

(58) Field of Classification Search .....
362/217.01–217.02, 218–219, 223, 249.02, 362/294, 373, 555
See application file for complete search history.

(56) References Cited

U.S. PATENT DOCUMENTS

| | | | | |
|---|---|---|---|---|
| 1,447,238 | A | | 3/1923 | Crownfield |
| 1,711,478 | A | | 4/1929 | Cromwell |
| 1,761,868 | A | | 6/1930 | Burke |
| 2,560,729 | A | | 7/1951 | Lynn et al. |
| 3,030,497 | A | | 4/1962 | Cheng |
| 4,136,474 | A | | 1/1979 | Belokin |
| 4,271,408 | A | | 6/1981 | Teshima et al. |
| 4,525,391 | A | | 6/1985 | Eckberg |
| 4,535,391 | A | | 8/1985 | Hsiao |
| 5,025,355 | A | | 6/1991 | Harwood |
| 5,103,382 | A | * | 4/1992 | Kondo et al. ..... 362/503 |
| 5,428,897 | A | | 7/1995 | Jordan et al. |
| 5,479,327 | A | | 12/1995 | Chen |
| 5,586,004 | A | | 12/1996 | Green et al. |
| 5,673,997 | A | | 10/1997 | Akiyama |
| 5,826,970 | A | | 10/1998 | Keller et al. |
| 5,913,617 | A | | 6/1999 | Helstern |
| 6,286,586 | B2 | | 9/2001 | Cook |
| 6,295,203 | B1 | | 9/2001 | Lo |
| 6,299,327 | B1 | | 10/2001 | Camarota |
| 6,343,871 | B1 | | 2/2002 | Yu |
| 6,361,186 | B1 | | 3/2002 | Slayden |
| 6,415,853 | B1 | | 7/2002 | Tao et al. |
| 6,448,900 | B1 | | 9/2002 | Chen |
| 6,547,417 | B2 | | 4/2003 | Lee |
| 6,561,690 | B2 | | 5/2003 | Balestriero et al. |
| 6,578,983 | B2 | | 6/2003 | Holten |
| 6,606,808 | B2 | | 8/2003 | Katz |

(Continued)

OTHER PUBLICATIONS

McGraw-Edison Installation Instructions: Oct. 1999.

*Primary Examiner* — Stephen F Husar
*Assistant Examiner* — Meghan Dunwiddie
(74) *Attorney, Agent, or Firm* — King & Spalding LLP

(57) ABSTRACT

A lighting system comprises a row of light emitting diodes ("LEDs") receiving electricity and producing light and heat. The row of LEDs can be located in a channel or a groove of a piece of material, such as an aluminum extrusion or a bent piece of metal. The channel can have an optically reflective lining, for example, providing either diffuse or specular reflection. Accordingly, the channel can reflect light emitted by the LEDs. The piece of material can also include a heat sink for transferring heat from the LEDs to air via convection or air flow. The heat sink can comprise fins or protrusions that facilitate convection.

20 Claims, 8 Drawing Sheets

U.S. PATENT DOCUMENTS 6,636,003 B2 10/2003 Rahm et al.
6,644,387 B1 11/2003 Lee et al.
6,682,211 B2 1/2004 English et al.
6,813,155 B2 11/2004 Lo
6,841,804 B1 1/2005 Chen et al.
6,853,151 B2 2/2005 Leong et al.
6,976,769 B2 12/2005 McCullough et al.
7,014,337 B2 3/2006 Chen
7,048,412 B2 5/2006 Martin et al.
7,090,375 B2 8/2006 Kuisma
7,121,684 B2 10/2006 Barozzini et al.
7,144,135 B2 12/2006 Martin et al.
7,175,313 B2 2/2007 Bednara et al.
7,242,028 B2 7/2007 Dry
D551,795 S 9/2007 Compton et al.
7,288,796 B2 10/2007 Dry
7,336,492 B2 2/2008 Yu
7,374,310 B2 5/2008 Barozzini et al.
7,440,280 B2 10/2008 Shuy
7,443,678 B2 10/2008 Han et al.
7,568,817 B2 8/2009 Lee et al.
7,591,578 B2 9/2009 Chang
7,593,229 B2 9/2009 Shuy
7,641,361 B2 1/2010 Wedell et al.
7,651,253 B2 1/2010 Shuy
7,686,469 B2 3/2010 Ruud et al.
7,748,876 B2 7/2010 Zhang et al.
7,952,262 B2 5/2011 Wilcox et al.
2004/0080938 A1 4/2004 Holman et al.
2005/0157500 A1 7/2005 Chen et al.
2005/0265019 A1* 12/2005 Sommers et al. ..... 362/217
2007/0206384 A1 9/2007 Compton et al.
2007/0217216 A1 9/2007 Goto et al.
2007/0285920 A1* 12/2007 Seabrook ..... 362/240
2008/0002399 A1 1/2008 Villard et al.
2008/0037239 A1* 2/2008 Thomas et al. ..... 362/92
2008/0074889 A1* 3/2008 Gloisten et al. ..... 362/341
2008/0316755 A1 12/2008 Zheng et al.
2009/0021944 A1 1/2009 Lee et al.
2009/0040759 A1 2/2009 Zhang et al.
2009/0046457 A1* 2/2009 Everhart ..... 362/235
2009/0073689 A1 3/2009 Patrick
2009/0080189 A1 3/2009 Wegner et al.
2009/0086476 A1 4/2009 Tickner et al.
2009/0086481 A1 4/2009 Wegner et al.
2009/0129086 A1 5/2009 Thompson
2009/0168439 A1* 7/2009 Chiang ..... 362/404
2009/0225549 A1 9/2009 Patrick
2009/0244896 A1 10/2009 McGehee et al.
2009/0262530 A1 10/2009 Tickner et al.
2009/0310330 A1 12/2009 Vann et al.
2009/0310361 A1 12/2009 Patrick
2009/0321598 A1 12/2009 Vann
2010/0091507 A1 4/2010 Li et al.
2010/0182782 A1 7/2010 Ladewig et al.
2010/0208460 A1 8/2010 Ladewig et al.

* cited by examiner

Arrows point towards decreasing temperature

LED-BASED LIGHTING SYSTEM AND METHOD

CROSS REFERENCE TO RELATED APPLICATIONS

This patent application is a continuation of and claims priority under 35 U.S.C. §120 to U.S. patent application Ser. No. 12/075,184, titled "LED-Based Lighting System and Method" and filed on Mar. 10, 2008 now U.S. Pat. No. 7,887,216, the entire contents of which is hereby incorporated herein by reference.

TECHNICAL FIELD

The present invention relates to illumination systems utilizing light emitting diodes ("LEDs") to provide visible or substantially white light, and more specifically to a luminaire incorporating a row of LEDs located in a reflective channel with a heat sink disposed alongside or behind the channel.

BACKGROUND

LEDs offer benefits over incandescent and fluorescent lights as sources of illumination. Such benefits include high energy efficiency and longevity. To produce a given output of light, an LED consumes less electricity than an incandescent or a fluorescent light. And, on average, the LED will last longer before failing.

The level of light a typical LED outputs depends upon the amount of electrical current supplied to the LED and upon the operating temperature of the LED. That is, the intensity of light emitted by an LED changes according to electrical current and LED temperature. Operating temperature also impacts the usable lifetime of most LEDs.

As a byproduct of converting electricity into light, LEDs generate heat that can raise the operating temperature if allowed to accumulate, resulting in efficiency degradation and premature failure. The conventional technologies available for handling and removing this heat are generally limited in terms of performance and integration. For example, most heat management systems are separated from the optical systems that handle the light output by the LEDs. The lack of integration often fails to provide a desirable level of compactness or to support efficient luminaire manufacturing.

Accordingly, to address these representative deficiencies in the art, an improved technology for managing the heat and light LEDs produce is needed. A need also exists for an integrated system that can manage heat and light in an LED-base luminaire. Yet another need exists for technology to remove heat via convection and conduction while controlling light with a suitable level of finesse. Still another need exists for an integrated system that provides thermal management, mechanical support, and optical control. An additional need exists for a compact lighting system having a design supporting low-cost manufacture. A capability addressing one or more of the aforementioned needs (or some similar lacking in the field) would advance LED lighting.

SUMMARY

The present invention can support illuminating an area or a space to promote observing or viewing items located therein. A lighting system comprising a light source, such as an LED, can comprise one or more provisions for managing light and heat generated by a light source. Managing heat can enhance efficiency and extend the source's life. Managing light can provide a beneficial illumination pattern.

In one aspect of the present invention, a lighting system, apparatus, luminaire, or device can comprise a row of LEDs. The row of LEDs, which are not necessarily in a perfect line with respect to one another, can emit or produce visible light, for example light that is white, red, blue, green, purple, violet, yellow, multicolor, etc. Additionally, the light can have a wavelength or frequency that a typical human can perceive visually. The emitted light can comprise photons, luminous energy, electromagnetic waves, radiation, or radiant energy.

The lighting system can further comprise one or more capabilities, elements, features, or provisions for managing light and heat produced by the row of LEDs. The row of LEDs can be disposed in a channel having a reflective lining or reflective sidewalls. That is, the LEDs can be located in a groove, an elongate cavity, a trough, or a trench with a surface for reflecting light the LEDs produce. The surface can be either smoothly polished to support specular reflection or roughened to support diffuse reflection. Accordingly, the channel can manage light from the LEDs via reflection. One or more features for managing heat produced by the LEDs can extend or run alongside the channel. For example, one or more protrusions, fins, or flutes can be located next to the channel. The features running alongside the channel can be behind the channel, in front of the channel, beside the channel, next to the channel, above the channel, adjacent the channel, beneath the channel, etc. Managing heat produced by the LEDs can comprise transferring the heat to air via air circulation or air movement.

The discussion of managing heat and light produced by LEDs presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one having ordinary skill in the art upon examination of the following drawings and detailed description. It is intended that all such aspects, systems, methods, features, advantages, and objects are included within this description, are within the scope of the present invention, and are protected by the accompanying claims.

Figure 1:
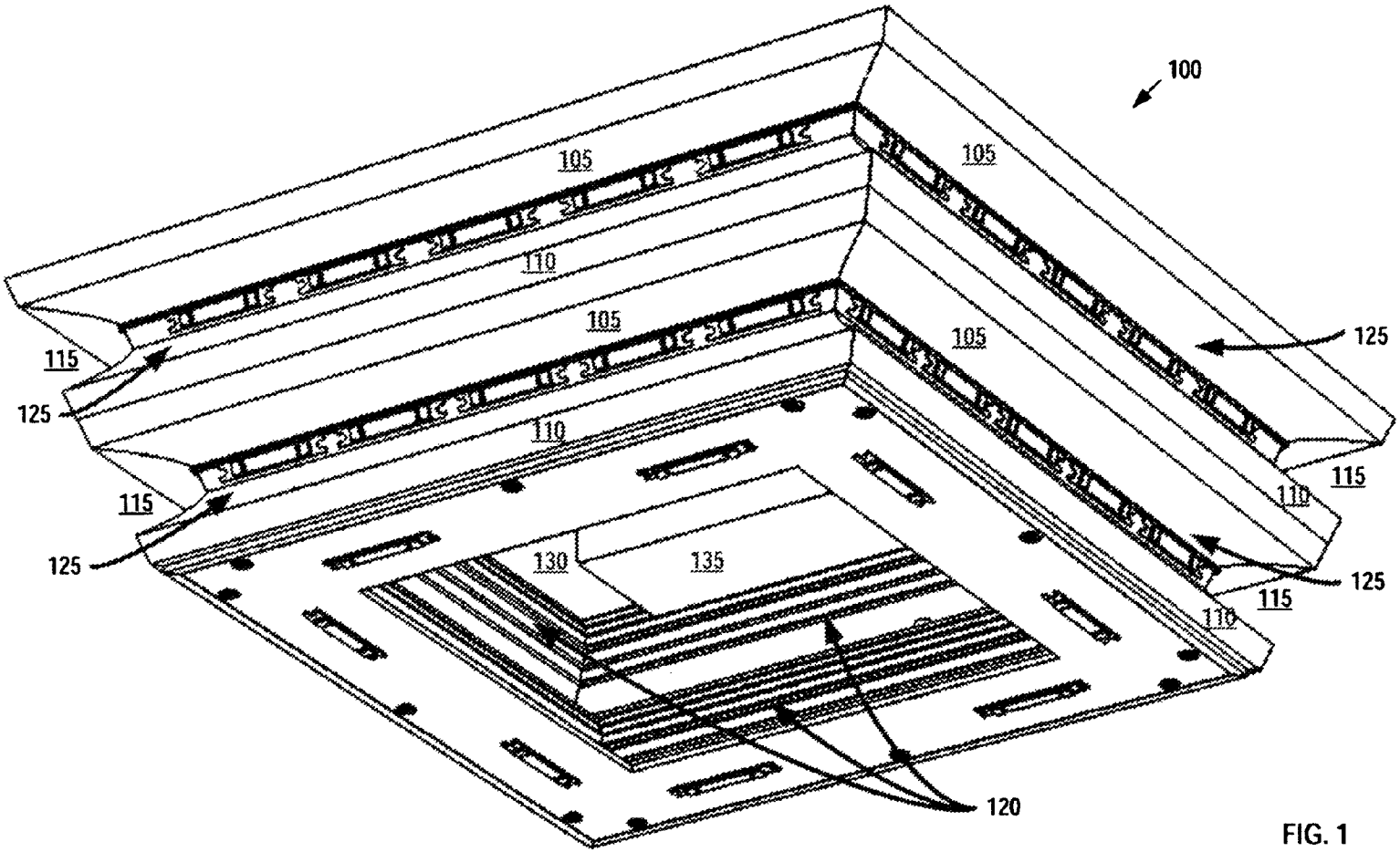
FIG. 1 is a perspective view from below of a lighting system comprising LEDs and a capability for managing heat and light output by the LEDs in accordance with certain exemplary embodiments of the present invention.

Many aspects of the invention can be better understood with reference to the above drawings. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

An exemplary embodiment of the present invention supports reliably and efficiently operating an LED-based lighting system or luminaire that is compact and configured for cost-effective fabrication. The lighting system can comprise a structural element that manages heat and light output by one or more LEDs. Fins, protrusions, or grooves can provide thermal management via promoting convection. A channel comprising a reflective lining can provide light management via diffuse or specular reflection or a combination of diffuse and specular reflection.

Figure 6:
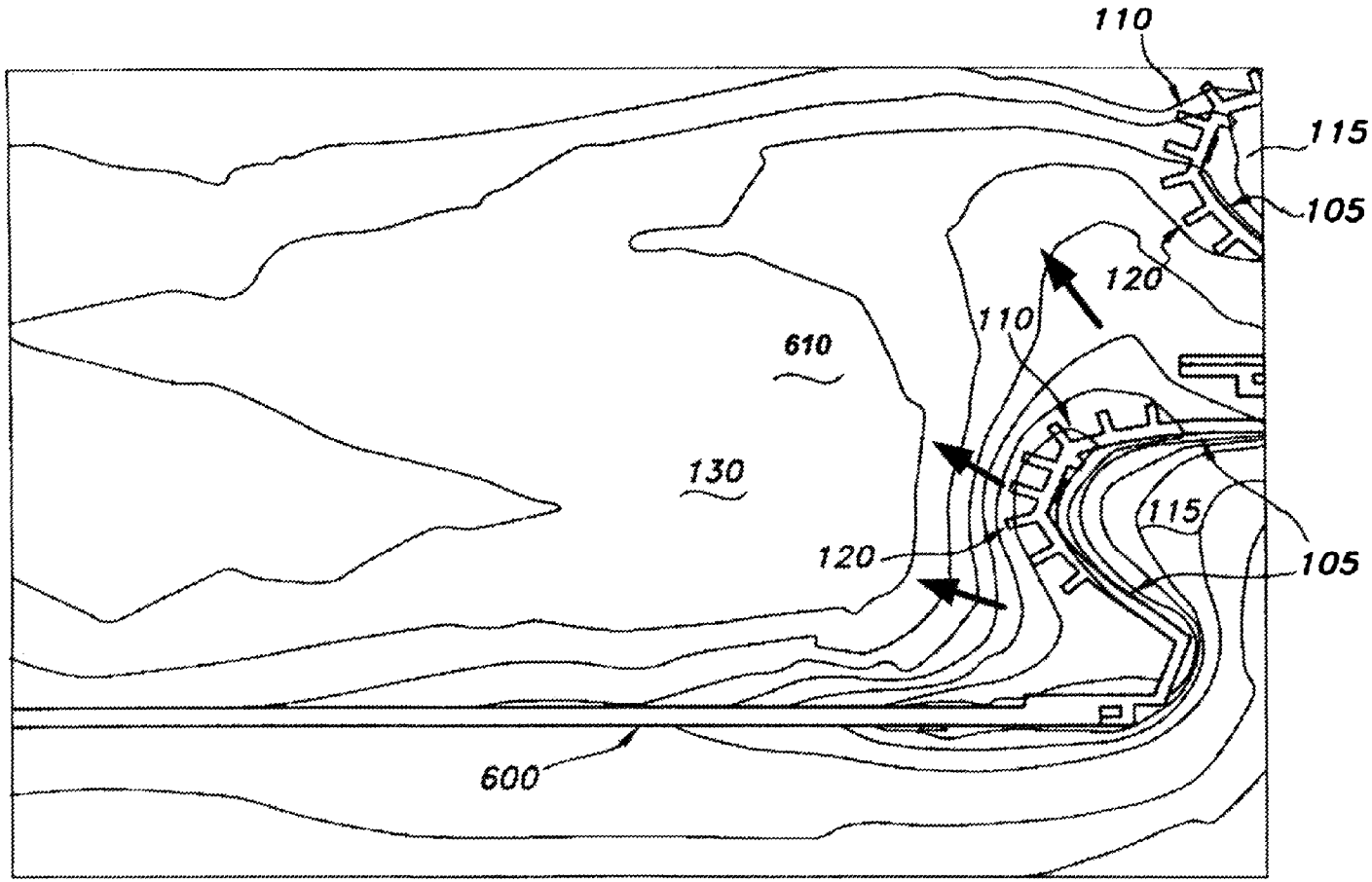
FIG. 6 is a plot of simulated thermal contours of a portion of a lighting system providing integrated light management and thermal management in accordance with certain exemplary embodiments of the present invention.
Figure 7:
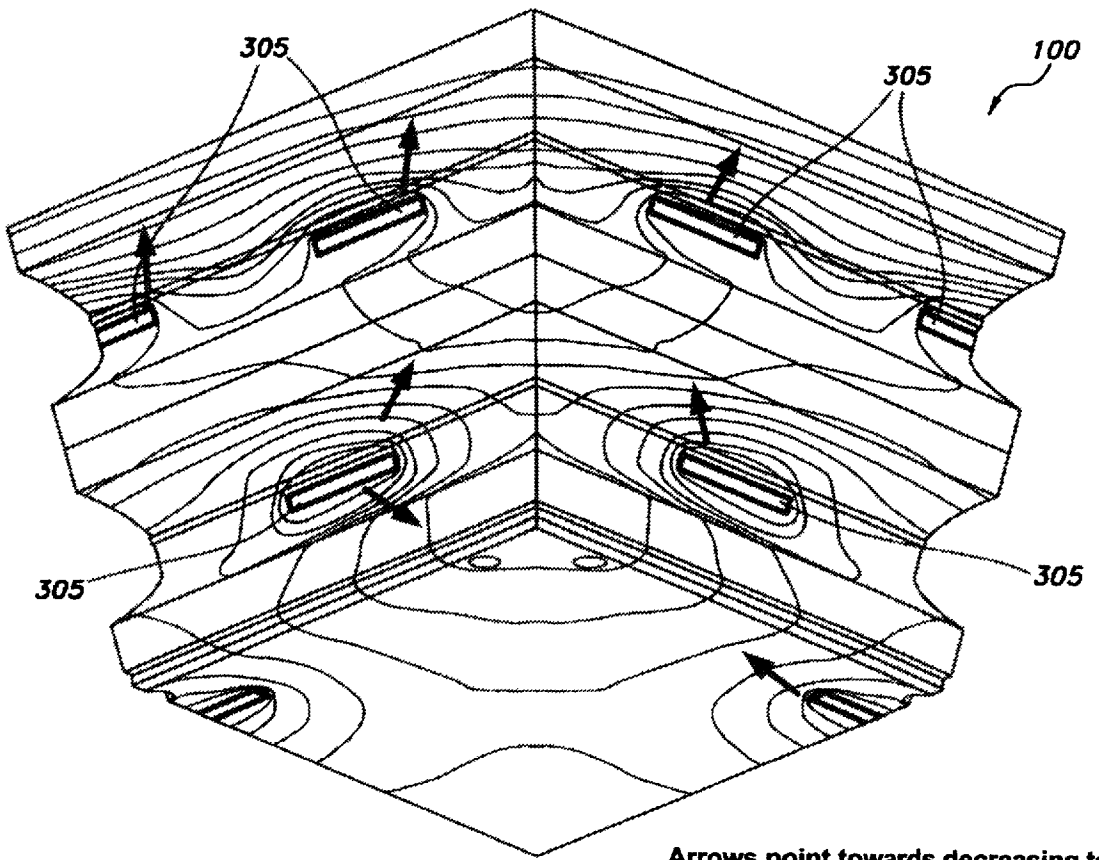
FIG. 7 is a plot of simulated thermal contours of a lighting system comprising LEDs and a capability for managing heat and light output by the LEDs in accordance with certain exemplary embodiments of the present invention.
Figure 8:
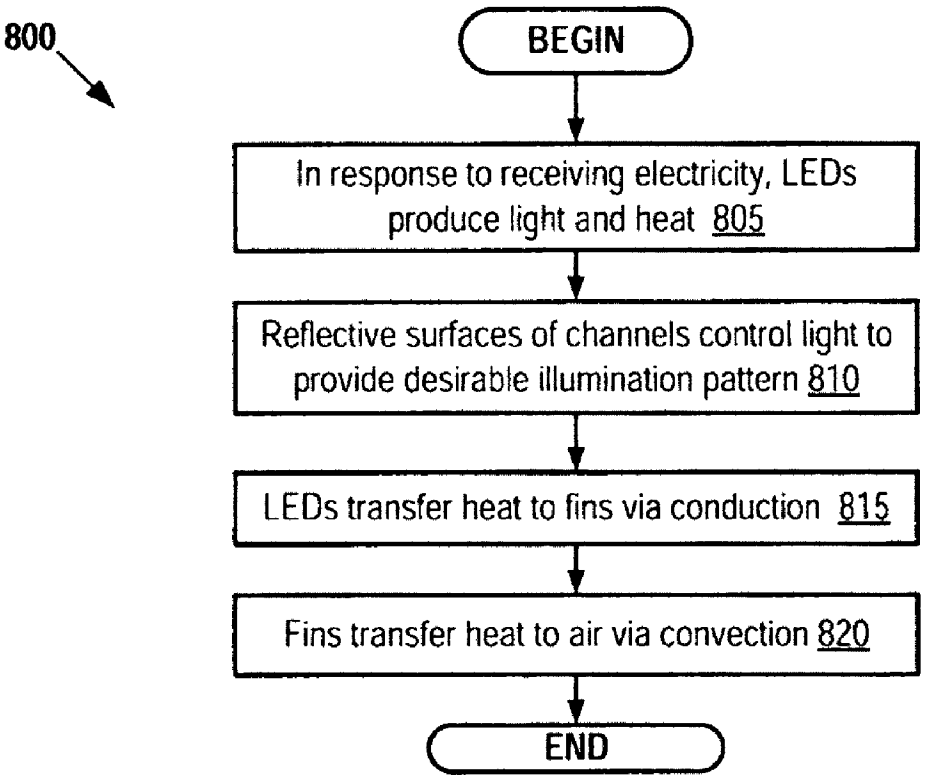
FIG. 8 is a flowchart of a method of operation of a lighting system comprising LEDs and a capability for managing heat and light output by the LEDs in accordance with certain exemplary embodiments of the present invention.

A lighting system will now be described more fully hereinafter with reference to FIGS. 1-8, which describe representative embodiments of the present invention. FIGS. 1-5 generally depict a representative LED-based lighting system with provisions for thermal and light management. FIGS. 6 and 7 illustrate simulated thermal performance of an representative LED-based lighting system. Finally, FIG. 8 provides a method of operation of an LED-based lighting system.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Figure 2:
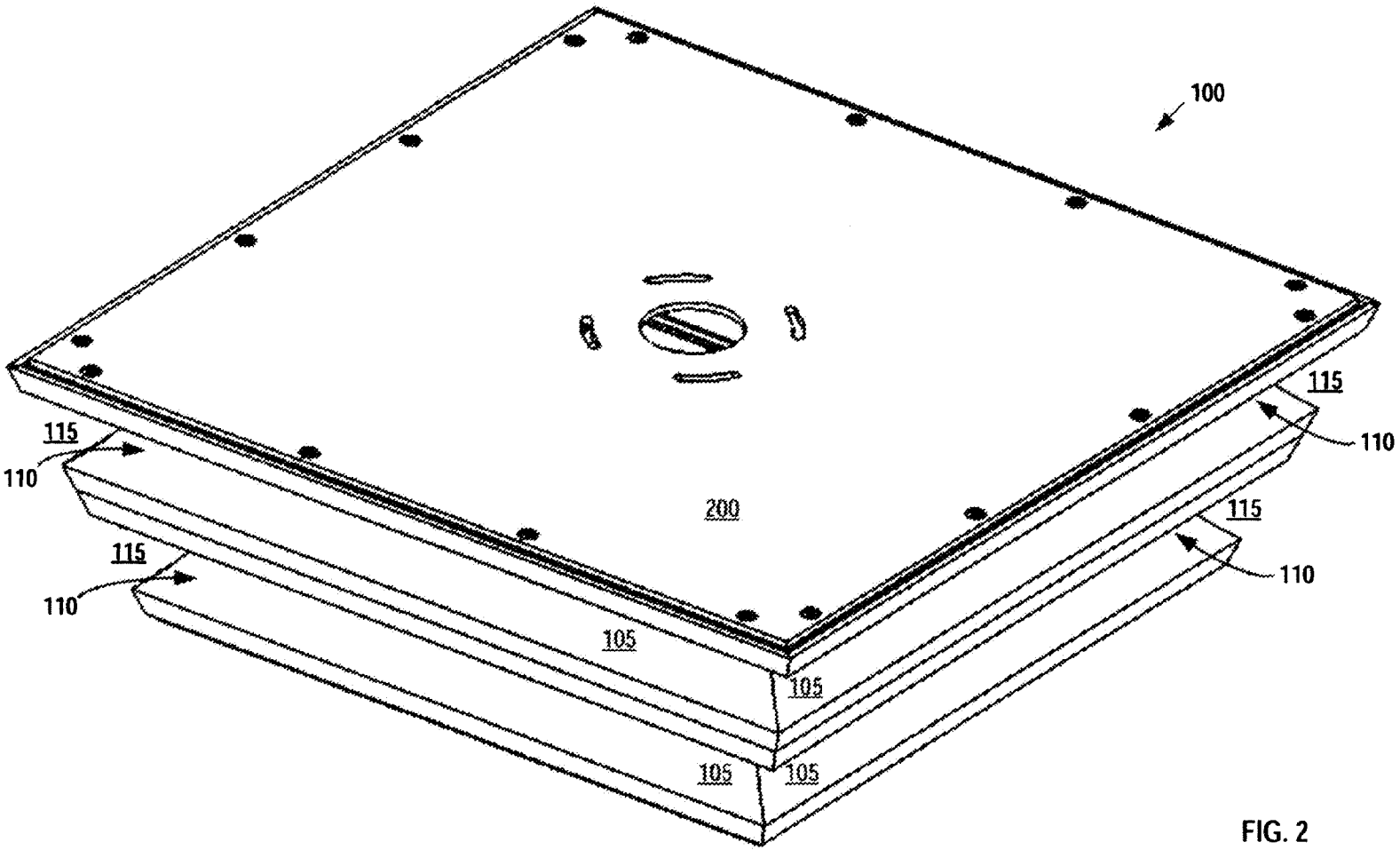
FIG. 2 is a perspective view from above of a lighting system comprising LEDs and a capability for managing heat and light output by the LEDs in accordance with certain exemplary embodiments of the present invention.

Turning now to FIGS. 1 and 2, these figures illustrate a lighting system 100 comprising LEDs (specifically the rows of LEDs 125) and a capability for managing heat and light output by the LEDs in accordance with certain exemplary embodiments of the present invention. FIG. 1 provides a perspective view from below, while FIG. 2 presents a top perspective.

In an exemplary embodiment, the lighting system 100 can be a luminaire or a lighting fixture for illuminating a space or an area that people may occupy or observe. In one exemplary embodiment, the lighting system 100 can be a luminaire suited for mounting to a ceiling of a parking garage or a similar structure.

The term "luminaire," as used herein, generally refers to a system for producing, controlling, and/or distributing light for illumination. A luminaire can be a system outputting or distributing light into an environment so that people can observe items in the environment. Such a system could be a complete lighting unit comprising: one or more LEDs for converting electrical energy into light; sockets, connectors, or receptacles for mechanically mounting and/or electrically connecting components to the system; optical elements for distributing light; and mechanical components for supporting or attaching the luminaire. Luminaries are sometimes referred to as "lighting fixtures" or as"light fixtures." A lighting fixture that has a socket for a light source, but no light source installed in the socket, can still be considered a luminaire. That is, a lighting system 20 lacking some provision for full operability may still fit the definition of a luminaire.

An optically transmissive cover (not illustrated) may be attached over the lighting system 100 to provide protection from dirt, dust, moisture, etc. Such a cover can control light via refraction or diffusion, for example. Moreover, the cover might comprise a refractor, a lens, an optic, or a milky plastic or glass element. As illustrated in FIG. 2, a top cover 200 faces the ceiling (or other surface) to which the lighting system 100 is mounted.

The exemplary lighting system 100 is generally rectangular in shape, and more particularly square. Other forms may be oval, circular, diamond-shaped, or any other geometric form. Two channels 115 extend around the periphery of the lighting system 100 to form a square perimeter. Two extrusions 110 provide the two channels 115. A row of LEDs 125 is disposed in each of the channels 115. Each channel 115 comprises a reflective surface 105 for manipulating light from the associated row of LEDs 125. The reflective surface 105 can comprise a lining of the channel 115, a film or coating of reflective or optical material applied to the channel 115, or a surface finish of the channel 115.

In one exemplary embodiment, the channel 115 has a uniform or homogenous composition, and the reflective surface 105 comprises a polished surface. Thus, the reflective surface 105 can be formed by polishing the channel 115 itself to support specular reflection or roughening the surface for diffuse reflection.

In one or more exemplary embodiments, each channel 115 can comprise a groove, a furrow, a trench, a slot, a trough, an extended cavity, a longitudinal opening, or a concave structure running lengthwise. A channel can include an open space as well as the physical structure defining that space. In other words, the channel 115 can comprise both a longitudinal space that is partially open and the sidewalls of that space.

In one exemplary embodiment, the reflective surfaces 105 are polished so as to be shiny or mirrored. In another exemplary embodiment, the reflective surfaces 105 are roughened to provide diffuse reflection. In another exemplary embodiment, each reflective surface 105 comprises a metallic coating or a metallic finish. For example, each reflective surface 105 can comprise a film of chromium or some other metal applied to a substrate of plastic or another material. In yet another exemplary embodiment, a conformal coating or a vapor-deposited coating can provide reflectivity.

Each extrusion 110 can have an aluminum composition or can comprise aluminum. As an alternative to fabrication via an extruding process, the channel 115 can be machined/cut into a bar of aluminum or other suitable metal, plastic, or composite material. Such machining can comprise milling, routing, or another suitable forming/shaping process involving material removal. In certain exemplary embodiments, the channels 115 can be formed via molding, casting, or die-based material processing. In one exemplary embodiment, the channels 115 are formed by bending strips of metal.

Each extrusion 110 comprises fins 120 opposite the channel 115 for managing heat produced by the associated row of LEDs 125. In an exemplary embodiment, the fins 120 and the channel 115 of each extrusion 110 are formed in one fabrication pass. That is, the fins 120 and the channel 115 are formed during extrusion, as the extrusion 110 is extruded.

As illustrated, the fins 120 of each extrusion 110 run or extend alongside, specifically behind, the associated channel 115. As discussed in further detail below, heat transfers from the LEDs via a heat-transfer path extending from the row of LEDs 125 to the fins 120. The fins 120 receive the conducted heat and transfer the conducted heat to the surrounding environment (typically air) via convection.

The two extrusions 110 extend around the periphery of the lighting system 100 to define a central opening 130 that supports convection-based cooling. An enclosure 135 located in the central opening 130 contains electrical support components, such as wiring, drivers, power supplies, terminals, connections, etc. In one exemplary embodiment, the enclosure 135 comprises a junction box or "j-box" for connecting the lighting system 100 to an alternating current power line. Alternatively, the lighting system 100 can comprise a separate junction box (not illustrated) located above the fixture.

Figure 3:
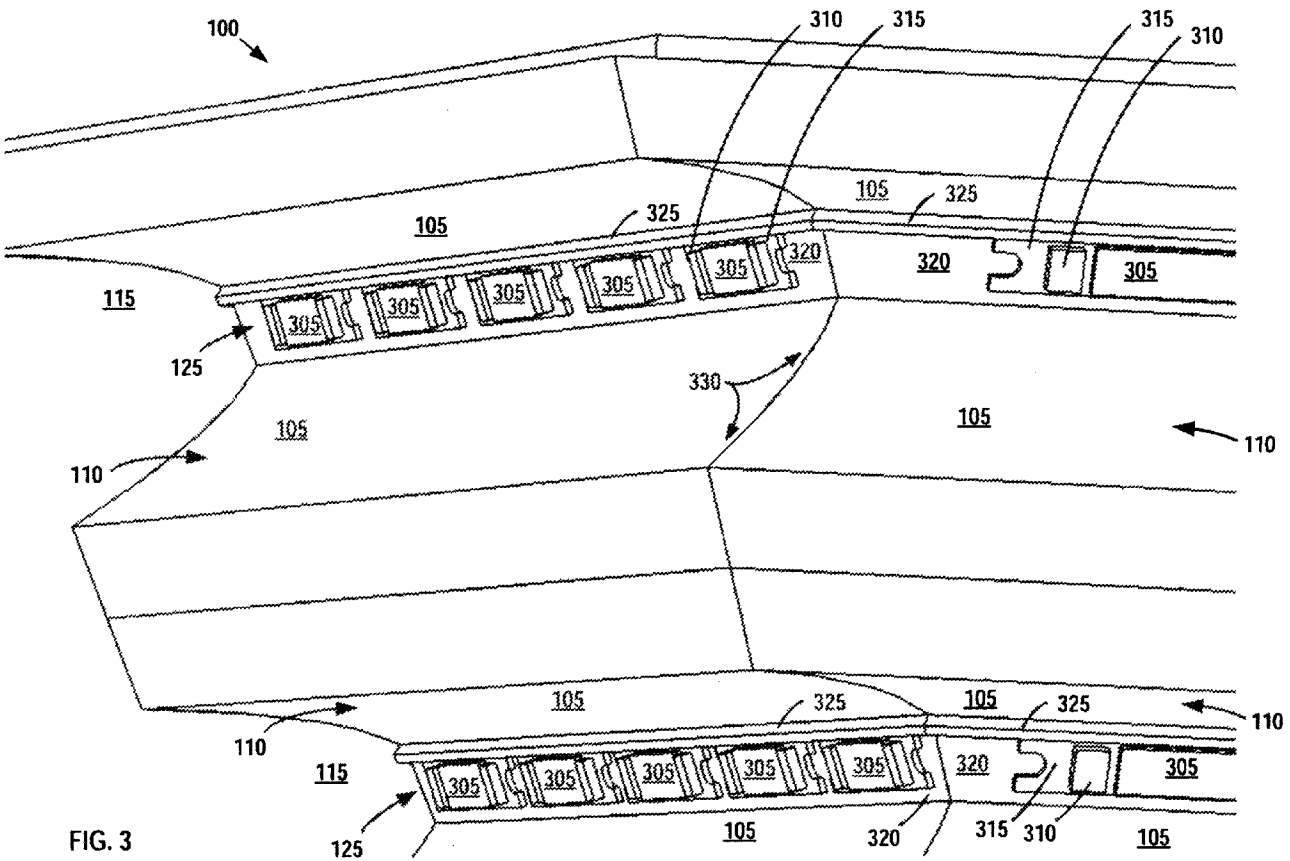
FIG. 3 is a detail view of a portion of a lighting system, illustrating two rows of LEDs respectively disposed in two channels, each formed in a member, in accordance with certain exemplary embodiments of the present invention.

Turning now to FIG. 3, this figure is a detail view of a portion of a lighting system 100, illustrating two rows of LEDs 125 respectively disposed in two channels 115, each formed in a respective member (specifically the extrusion 110), in accordance with certain exemplary embodiments of the present invention. More specifically, FIG. 3 provides a detail view of a portion of the exemplary lighting system 100 depicted in FIGS. 1 and 2 and discussed above. The view faces a miter joint 330 at a corner of the lighting system 100, where two segments of extrusion 110 meet. In an alternative embodiment, the miter joint 330 can be replaced with another suitable joint.

In the illustrated exemplary embodiment, each row of LEDs 125 is attached to a flat area 320 of the associated extrusion 110. The term "row," as used herein, generally refers to an arrangement or a configuration whereby items are disposed approximately in or along a line. Items in a row are not necessarily in perfect alignment with one another. Accordingly, one or more elements in the row of LEDs 125 might be slightly out of perfect alignment, for example in connection with manufacturing tolerances or assembly deviations. Moreover, elements might be purposely staggered.

Each row of LEDs 125 comprises multiple modules, each comprising at least one solid state light emitter or LED, represented at the reference number "305." Each of these modules can be viewed as an exemplary embodiment of an LED and thus will be referred to hereinafter as LED 305. In another exemplary embodiment, an LED can be a single light emitting component (without necessarily being included in a module or housing potentially containing other items).

Each LED 305 is attached to a respective substrate 315, which can comprise one or more sheets of ceramic, metal, laminates, or circuit board material, for example. The attachment between LED 305 and substrate 315 can comprise a solder joint, a plug, an epoxy or bonding line, or another suitable provision for mounting an electrical/optical device on a surface. Support circuitry 310 is also mounted on each substrate 315 for supplying electrical power and control to the associated LED 305. The support circuitry 310 can comprise one or more transistors, operational amplifiers, resistors, controllers, digital logic elements, etc. for controlling and powering the LED.

In an exemplary embodiment, each substrate 315 adjoins, contacts, or touches the flat area 320 of the extrusion 110 onto which each substrate 315 is mounted. Accordingly, the thermal path between each LED 305 and the associated fins 120 can be a continuous path of solid or thermally conductive material. In one exemplary embodiment, that path can be void of any air interfaces, but may include multiple interfaces between various solid materials having distinct thermal conductivity properties. In other words, heat can flow from each LED 305 to the associated fins 120 freely or without substantive interruption or interference.

The substrates 315 can attach to the flat areas 320 of the extrusion 110 via solder, braze, welds, glue, plug-and-socket connections, epoxy, rivets, clamps, fasteners, etc. A ridge 325 provides an alignment surface so that each substrate 315 makes contact with the ridge 325. Moreover, contact between the substrates 315 and the ridge 325 provides an efficient thermal path from the LEDs 305 to the extrusion 110, and onto the fins 120, as discussed above. Accordingly, substrate-to-extrusion contact (physical contact and/or thermal contact) can occur at the flat area 320, at the ridge 325, or at both the flat area 320 and the ridge 325.

In an exemplary embodiment, the LEDs 305 comprise semiconductor diodes emitting incoherent light when electrically biased in a forward direction of a p-n junction. In an exemplary embodiment, each LED 305 emits blue or ultraviolet light, and the emitted light excites a phosphor that in turn emits red-shifted light. The LEDs 305 and the phosphors can collectively emit blue and red-shifted light that essentially matches blackbody radiation. Moreover, the emitted light may approximate or emulate incandescent light to a human observer. In one exemplary embodiment, the LEDs 305 and their associated phosphors emit substantially white light that may seem slightly blue, green, red, yellow, orange, or some other color or tint. Exemplary embodiments of the LEDs 305 can comprise indium gallium nitride ("InGaN") or gallium nitride ("GaN") for emitting blue light.

In an alternative embodiment, multiple LED elements (not illustrated) are mounted on each substrate 315 as a group. Each such mounted LED element can produce a distinct color of light. Meanwhile, the group of LED elements mounted on one substrate 315 can collectively produce substantially white light or light emulating a blackbody radiator.

In one exemplary embodiment, some of the LEDs 305 can produce red light, while others produce, blue, green, orange, or red, for example. Thus, the row of LEDs 125 can provide a spatial gradient of colors.

In one exemplary embodiment, optically transparent or clear material encapsulates each LED 305, either individually or collectively. Thus, one body of optical material can encapsulate multiple light emitters. Such an encapsulating material can comprise a conformal coating, a silicone gel, cured/curable polymer, adhesive, or some other material that provides environmental protection while transmitting light. In one exemplary embodiment, phosphors, for converting blue light to light of another color, are coated onto or dispersed in such encapsulating material.

Figure 4:
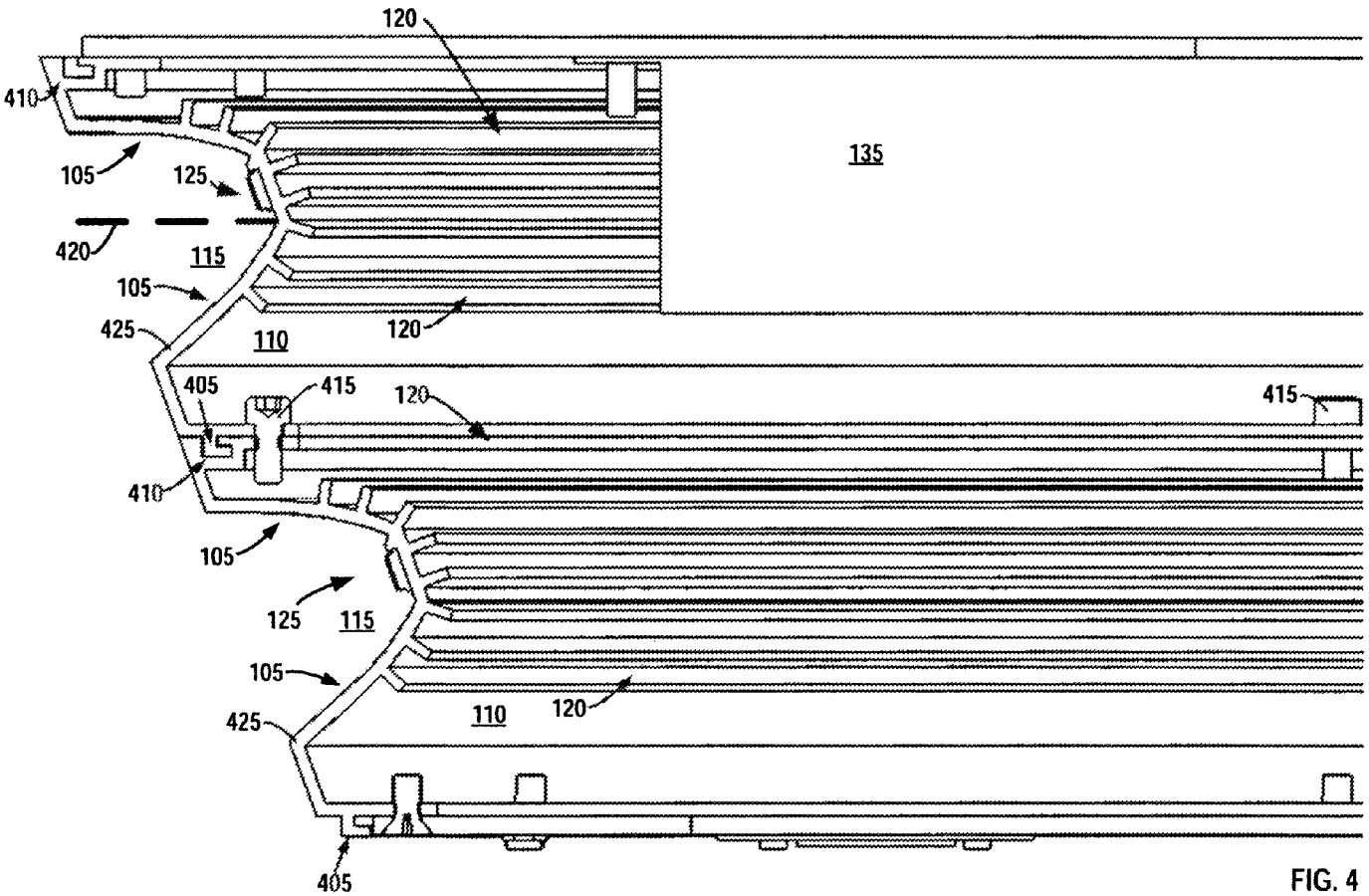
FIG. 4 is a line drawing providing an internal view of a portion of a lighting system, illustrating thermal management features in accordance with certain exemplary embodiments of the present invention.

Turning now to FIG. 4, this figure depicts an internal perspective view of a portion of a lighting system 100, illustrating thermal management features in accordance with certain exemplary embodiments of the present invention. More specifically, FIG. 4 illustrates two extrusions 110 as viewed from the central opening 130 of the exemplary lighting system 100 discussed above with reference to FIGS. 1, 2, and 3. The two illustrated extrusions 110 have beveled faces 42S to provide the miter joint 330 shown in FIG. 3. For clarity, FIG. 4 illustrates only one half of the miter joint 330 (excluding two of the four extrusion segments depicted in FIG. 3).

The fins 120 run essentially parallel to each channel 115 (within typical manufacturing tolerances that accommodate some deviation). Moreover, the fins 120, the rows of LEDs 125, the extrusions 110, and the channels 115 extend along a common axis 420, which has been located in an arbitrary or illustrative position in FIG. 4.

Figure 5:
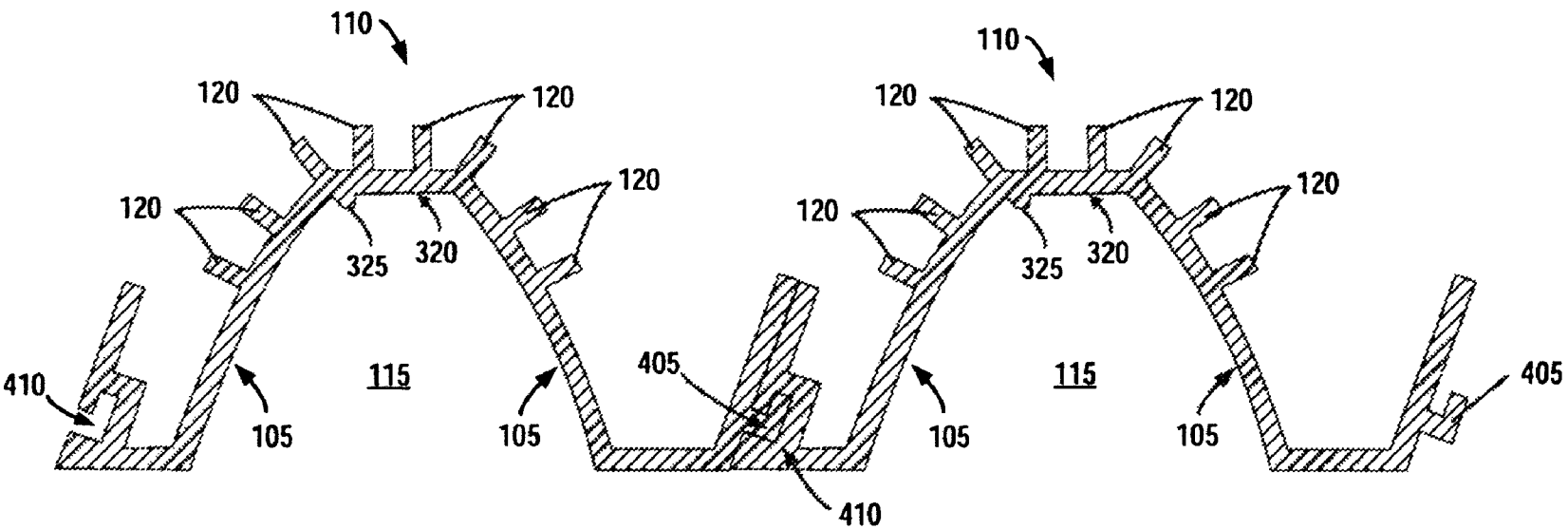
FIG. 5 is a cross sectional view of two members of a lighting system, each providing integrated light management and thermal management in accordance with certain exemplary embodiments of the present invention.

As further illustrated in FIG. 5, each extrusion 110 comprises a slot 410 and a 10 protrusion 405 for coupling the two, side-by-side extrusions 110 together. The slot 410 provides a female receptacle, and the protrusion 405 provides a male plug that mates in the receptacle. With the protrusion 405 disposed in the slot 410, threaded fasteners 415 hold the two extrusions 110, thereby providing a rigid, aligned assembly. In one exemplary embodiment, the two extrusions 110 are held together via a tongue-in-groove connection.

Turning now to FIG. 5, this figure illustrates a cross sectional view of two members (exemplarily embodied in the two extrusions 110) of a lighting system 100, each providing integrated light management and thermal management in accordance with certain exemplary embodiments of the present invention.

FIG. 5 illustrates in further detail the fastening system that connects the two extrusions 110 together, wherein the protrusion 40S is seated in the slot 410. In an exemplary embodiment, the protrusion 405 and the slot 410 are keyed one to the other. Moreover, the slot 410 captures the protrusion 405. Capturing the protrusion 405 can comprise encumbering (or preventing) at least one dimension (or at least one direction) of movement.

Inserting the protrusion 405 in the slot 410 typically comprises sliding the protrusion 405 into the slot 410. In an exemplary assembly procedure, two extrusions 110 are oriented end-to-end. Next, one of the two extrusions 110 is moved laterally until the end of the protrusion 405 is aligned with the end opening of the slot 410. The 30 two extrusions 110 are then moved longitudinally towards one another so that the protrusion 405 slides into the slot 410. With the protrusion 405 so captured in the slot 410, disassembly entails sliding the two protrusions 405 apart, rather than applying lateral separation force.

While FIG. 5 illustrates exactly two extrusions 110 joined together, additional extrusions can be coupled to another. Each extrusion 110 has a slot 410 on one side and a protrusion 405 on the other side so that two, three, four, five, or more extrusions 110 can be joined to provide an array of LED lighting strips.

FIG. 5 further illustrates how a single member, in this case each extrusion 110, can provide structural support, light management via reflection from the surface 105, and thermal or heat management via the fins 120. In other words, one system can provide integrated heat and light management in a structural package. Moreover, a unitary or single body of material, in this example each extrusion 110, can have a reflective contour on one side and a heat-sink contour on the opposite side. An efficient thermal path can lead from an LED-mounting platform, associated with the reflective contour, to the heat-sink contour. As discussed above, such a LED-mounting platform, a reflective contour, and a heat-sink contour can be exemplarily embodied in the flat area 320, the reflective surface 105, and the fins 120, respectively.

Although FIG. 5 illustrates the reflective contour as a parabolic form, the reflective surface 105 can be flat, elliptical, circular, convex, concave, or some other geometry as may be beneficial for light manipulation in various circumstances. Similarly, the fins 120 can have a wide variety of forms, shapes, or cross sections, for example pointed, rounded, double convex, double concave, etc. Moreover, although eight fins 120 are illustrated for each extrusion 110, other embodiments may have fewer or more fins 120. As discussed above, the fins 120 transfer heat, produced by the LEDs 305, to surrounding air via circulating or flowing air. Thus, the fins 120 promote convection-based cooling.

Turning now to FIG. 6, this figure illustrates a plot of simulated thermal contours of a portion of a lighting system 100 providing integrated light management and thermal management in accordance with certain exemplary embodiments of the present invention. More specifically, FIG. 6 illustrates temperature gradients via showing lines (or regions) of equal (or similar) temperature for a cross section of the exemplary lighting system 100 illustrated in FIGS. 1-5 and discussed above.

The illustrated cross section cuts though a lower cover 600 (not depicted in FIGS. 1-5) and the extrusions 110. The illustrated temperature profile, which was generated via a computer simulation, demonstrates how the fins 120 transfer heat to air 610. Accordingly, heat moves away from the LEDs 305 and is dissipated into the operating environment, thereby avoiding excessive heat buildup that can negatively impact operating efficiency and can contribute to premature failure.

Turning now to FIG. 7, this figure illustrates a plot of simulated thermal contours of a lighting system 100 comprising LEDs 305 and a capability for managing heat and light output by the LEDs 305 in accordance with certain exemplary embodiments of the present invention. Similar to FIG. 6, FIG. 7 illustrates temperature gradient via showing lines (or regions) of equal (or similar) temperature for an exemplary embodiment of a lighting system 100.

The thermal management provisions of the lighting system 100 transfer heat away from the LEDs 305 to support efficient conversion of electricity into light and further to provide long LED life.

Turning now to FIG. 8, this figure illustrates a flowchart of a method 800 of operation of a lighting system 100 comprising LEDs 305 and a capability for managing heat and light output by the LEDs 305 in accordance with certain exemplary embodiments of the present invention.

At step 805 of the method 800, the LEDs 305 receive electricity from a power supply that may be located in the enclosure 135 or mounted on the substrate 315, for example. In one exemplary embodiment, an LED power supply delivers electrical current to the LEDs 305 via circuit traces printed on the substrate 315. The current can be pulsed or continuous and can be pulse width modulated to support user-controlled dimming. In response to the applied current, the LEDs 305 produce heat while emitting or producing substantially white light or some color of light that a person can perceive. As discussed above, in one exemplary embodiment, at least one of the LEDs 305 produces blue or ultraviolet light that triggers photonic emissions from a phosphor. Those emissions can comprise green, yellow, orange, and/or red light, for example. In other words, the LEDs 305 produce light and heat as a byproduct.

At step 810, the reflective surfaces 105 of the channels 115 direct the light outward from the lighting system 100. The light emanates outward and, to a lesser degree, downward. Directing the light radially outward, while maintaining a downward aspect to the illumination pattern, helps the lighting system 100 illuminate a relatively large area, as may be useful for a parking garage or similar environment.

At step 815, the heat generated by the LEDs 305 transfers to the fins 120 via conduction, As discussed above, in an exemplary embodiment, the materials in the heat transfer path between the LEDs 305 and the fins 120 can have a high level of thermal conductivity, for example similar to or higher than any elemental metal. Accordingly, 10 in an exemplary embodiment, the heat conduction can be efficient or unimpeded.

At step 820, the fins 120 transfer the heat to the air 610 via convection. In an exemplary embodiment, the heat raises the temperature of the air 610 causing the air 610 to circulate, flow, or otherwise move. The moving air carries additional heat away from the fins 120, thereby maintaining the LEDs 305 at an acceptable operating temperature. As discussed above, such a temperature can help extend LED life while promoting electrical efficiency.

Technology for managing heat and light of an LED-based lighting system has been described. From the description, it will be appreciated that an embodiment of the present invention overcomes limitations of the prior art. Those having ordinary skill in 20 the art will appreciate that the present invention is not limited to any specifically discussed application or implementation and that the embodiments described herein are illustrative and not restrictive. From the description of the exemplary embodiments, equivalents of the elements shown herein will suggest themselves to those having ordinary in the art, and ways of constructing other embodiments of the present invention will appear to practitioners of the art. Therefore, the scope of the present invention is to be limited only by the claims that follow.

What is claimed is:

1. A lighting system, comprising:

an integrated member comprising:

a channel including a flat surface, a first contoured surface extending beyond a plane of the flat surface, and a second contoured surface extending beyond the plane of the flat surface and opposing the first contoured surface; and a plurality of protrusions running alongside a back side of the flat surface, the first contoured surface, or the second contoured surface of the channel; and a plurality of light emitting diodes mounted on one or more respective substrates that are disposed on the flat surface and in thermal contact with the integrated member, wherein each protrusion is operative to dissipate heat conducted by the light emitting diodes.

2. The lighting system of claim 1, wherein the integrated member comprises one or more solid materials forming a heat conductive path operative to conduct heat from the plurality of light emitting diodes to the plurality of protrusions, and the plurality of protrusions are operative to dissipate the conducted heat via convection.

3. The lighting system of claim 1, further comprising:

a second integrated member comprising:

a second channel including flat and contoured surfaces, and a second plurality of protrusions running alongside a back side of the flat and contoured surfaces of the second channel; and a second plurality of light emitting diodes disposed in the second channel.

4. A lighting system, comprising:

an integrated member comprising:

a channel including a flat surface, a first contoured surface extending beyond a plane of the flat surface, and a second contoured surface extending beyond the plane of the flat surface and opposing the first contoured surface; and a plurality of protrusions running alongside a back side of the flat surface, the first contoured surface, or the second contoured surface of the channel; and a plurality of light emitting diodes mounted on one or more respective substrates that are disposed on the flat surface and in thermal contact with the integrated member, wherein each protrusion is operative to dissipate heat conducted by the light emitting diodes;

wherein the first and second contoured surfaces comprise optically reflective surfaces, and the integrated member further comprises a slot adjoining the first contoured surface and a plug adjoining the second contoured surface, the slot and the plug for mating the integrated member with another integrated member.

5. A lighting system, comprising:

an integrated member comprising:

a channel including a flat surface, a first contoured surface extending beyond a plane of the flat surface, and a second contoured surface extending beyond the plane of the flat surface and opposing the first contoured surface; and a plurality of protrusions running alongside a back side of the flat surface, the first contoured surface, and the second contoured surface of the channel; and a plurality of light emitting diodes mounted on one or more respective substrates that are disposed on the flat surface and in thermal contact with the integrated member, wherein each protrusion is operative to dissipate heat conducted by the light emitting diodes;

wherein at least two of the plurality of protrusions are disposed outside each of the flat surface, the first contoured surface, and the second contoured surface of the channel and are operative to dissipate heat produced by the plurality of light emitting diodes.

6. A lighting system, comprising:

an integrated member comprising:

a channel including a flat surface, a first contoured surface extending beyond a plane of the flat surface, and a second contoured surface extending beyond the plane of the flat surface and opposing the first contoured surface; and a plurality of protrusions running alongside a back side of the flat surface, the first contoured surface, or the second contoured surface of the channel; and a plurality of light emitting diodes mounted on one or more respective substrates that are disposed on the flat surface and in thermal contact with the integrated member, wherein each protrusion is operative to dissipate heat conducted by the light emitting diodes;

wherein the channel extends around a periphery of a luminaire to form a complete geometric perimeter and the plurality of light emitting diodes are disposed around the periphery of the luminaire.

7. The lighting system of claim 6, wherein the complete geometric perimeter forms a rectangle and the plurality of protrusions running alongside the channel are disposed behind the channel.

8. A lighting system, comprising:

an integrated member comprising:

a first substantially planar surface;

a first contoured surface adjoining the first substantially planar surface;

a second contoured surface adjoining the first substantially planar surface and opposing the first contoured surface;

a slot adjoining the first contoured surface;

a plug adjoining the second contoured surface, the slot and the plug for mating the integrated member with another integrated member; and a plurality of protrusions each operative to dissipate heat via convection; and a plurality of light sources disposed on the first substantially planar surface, wherein the integrated member comprises one or more solid materials forming a heat conductive path operative to conduct heat from the plurality of light sources to the plurality of protrusions.

9. The lighting system of claim 8, wherein the plurality of light sources comprise a plurality of light emitting diodes mounted on at least one substrate, the plurality of protrusions comprise a plurality of fins, and the first and second contoured surfaces comprise reflective surfaces.

10. The lighting system of claim 8, wherein the first substantially planar surface, the first contoured surface, and the second contoured surface form a channel.

11. The lighting system of claim 8, wherein the first substantially planar surface and the plurality of protrusions extend lengthwise along a common axis.

12. The lighting system of claim 8, wherein the integrated member extends around a periphery of a lighting fixture to form a complete geometric perimeter and the plurality of light sources comprise a plurality of light emitting diodes disposed around the periphery.

13. The lighting system of claim 12, wherein the complete geometric perimeter forms a rectangle.

14. The lighting system of claim 8, further comprising:

a second integrated member extending longitudinally alongside the integrated member and comprising:

a second substantially planar surface and contoured surfaces opposing each other and adjoining the second substantially planar surface; and a plurality of second protrusions disposed along a back side of the second integrated member, each second protrusion operative to dissipate heat; and a second plurality of light sources disposed on the second substantially planar surface.

15. The lighting system of claim 14, wherein the second substantially planar surface and the contoured surfaces form a channel, and the contoured surfaces of the second integrated member comprise optically reflective surfaces.

16. The lighting system of claim 8, wherein the plurality of light sources comprise a plurality of light emitting diodes mounted to at least one thermally conductive substrate disposed on the first substantially planar surface and transferring heat generated by the plurality of light emitting diodes to the integrated member.

17. A luminaire, comprising:

one or more integrated members extending to form a complete rectangle about a central area, each of the one or more integrated members comprising:

a first surface comprising a substantially planar channel;

a first contoured surface adjoining the first substantially planar channel;

a second contoured surface adjoining the first substantially planar channel and opposing the first contoured surface; and a plurality of protrusions extending along a back side of the one or more integrated members; and a plurality of light emitting diodes disposed along the substantially planar channel.

18. The luminaire of claim 17, wherein the plurality of protrusions comprise heat sink fins and the first and second contoured surfaces comprise reflective surfaces.

19. The luminaire of claim 17, wherein the first and second contoured surfaces comprise optically reflective surfaces, and each of the one or more integrated members further comprises a slot and a plug for mating with at least one other integrated member.

20. The luminaire of claim 19, wherein the first surface and the first and second contoured surfaces combine to form a concave shape, and for each of the one or more integrated members, the slot adjoins the first contoured surface and the plug adjoins the second contoured surface.

* * * * *